US010696438B2

(12) United States Patent
Schilling

(10) Patent No.: US 10,696,438 B2
(45) Date of Patent: Jun. 30, 2020

(54) SHRINK TUNNEL

(71) Applicant: KHS GmbH, Dortmund (DE)

(72) Inventor: Christian Schilling, Diemelsee (DE)

(73) Assignee: KHS GmbH, Dortmund (DE)

( * ) Notice: Subject to any disclaimer, the term of this patent is extended or adjusted under 35 U.S.C. 154(b) by 268 days.

(21) Appl. No.: 15/754,468

(22) PCT Filed: Aug. 22, 2016

(86) PCT No.: PCT/EP2016/069767
§ 371 (c)(1),
(2) Date: Feb. 22, 2018

(87) PCT Pub. No.: WO2017/032727
PCT Pub. Date: Mar. 2, 2017

(65) Prior Publication Data

US 2018/0229878 A1 Aug. 16, 2018

(30) Foreign Application Priority Data

Aug. 26, 2015 (DE) ..... 10 2015 114 161

(51) Int. Cl.
*B65B 53/06* (2006.01)
*B65B 59/02* (2006.01)

(52) U.S. Cl.
CPC ..... *B65B 53/063* (2013.01); *B65B 53/066* (2013.01); *B65B 59/02* (2013.01)

(58) Field of Classification Search
CPC ..... B65B 53/06; B65B 53/063; B65B 53/066
USPC ..... 53/442, 557; 392/382
See application file for complete search history.

(56) References Cited

U.S. PATENT DOCUMENTS

| | | | | |
|---|---|---|---|---|
| 3,222,800 | A * | 12/1965 | Siegel et al. | B65B 53/063 34/212 |
| 3,312,811 | A * | 4/1967 | Shanklin | B65B 53/063 219/388 |
| 3,526,752 | A * | 9/1970 | Bell | B65B 53/063 219/388 |
| 6,689,180 | B1 | 2/2004 | Liao | |
| 2010/0031608 | A1 * | 2/2010 | Schilling | B65B 53/063 53/442 |

FOREIGN PATENT DOCUMENTS

| | | | | |
|---|---|---|---|---|
| DE | 27 13 407 | | 10/1977 | |
| DE | 84 11 758 | | 7/1984 | |
| DE | 8411758 | U1 * | 7/1984 | B65B 53/06 |
| DE | 102006036590 | | 2/2008 | |
| DE | 10 2012 103398 | | 10/2013 | |
| DE | 10 2012 103402 | | 10/2013 | |
| EP | 2 653 394 | | 10/2013 | |
| EP | 2653394 | A1 * | 10/2013 | B65B 53/063 |

* cited by examiner

*Primary Examiner* — Stephen F. Gerrity
(74) *Attorney, Agent, or Firm* — Occhiuti & Rohlicek LLP

(57) ABSTRACT

A shrink tunnel for shrinking shrink films on packages includes a transport path that passes through the treatment chamber. Arrays on opposite sides thereof have nozzles for dispensing hot gas. Each array has an associated guide plate and a lifting device for adjusting the guide plate. Adjusting the guide plates covers up certain nozzles, thus controlling the flow of air on the packages.

13 Claims, 6 Drawing Sheets

SHRINK TUNNEL

RELATED APPLICATIONS

This is the national stage under 35 USC 371 of international application PCT/FP2016/069767, filed on Aug. 22, 2016, which claims the benefit of the Aug. 26, 2015 of German application DE 10-2015-114161.2, the contents of which are herein incorporated by reference.

FIELD OF INVENTION

The invention relates to shrink-wrapping of packages, and in particular, to a shrink tunnel.

BACKGROUND

It is known to package products together in packs. These packs are often shrink-wrapped. The shrink wrapping process involves passing the pack, which has been draped with shrink film, through a shrink tunnel.

Within the shrink tunnel are arrays of nozzles that blow hot air against the shrink film. To promote good shrink wrapping, it is useful for these nozzles to be pointed to target specific regions of the package. To assist in targeting the correct places on a package, it is useful to provide shutters over some nozzles.

It is often desirable to direct hot air leaving the nozzles so that it strikes the packs just below the top of the containers first. It is also often desirable to protect certain parts of the pack from hot air. These can both be achieved by covering selected nozzles with at least one shutter or guide plates.

SUMMARY

It is an object of the invention to provide a shrink tunnel that allows guide plates thereof to be optimally adjusted and/or positioned regardless of the height of the products passing through the shrink tunnel.

In one aspect, the guide plates are provided singly and separately at the arrays that comprise a plurality of nozzle openings or at the nozzle bodies that comprise the nozzle openings. The guide plates' positions are adjustable in regard to their position by lifting devices. Preferably, it is their height that is adjustable. The guide plates can be adjusted in common or individually.

The lifting devices and all of their associated functional elements are located outside the overall cross-sections of the transport path or of the treatment chamber whatever the position of the guide plates.

The shrink tunnel also dispenses with the hitherto customary bearer for the guide plates. This bearer ran transversely through the treatment chamber of the transport path and allowed the guide plates to be arranged in their lowermost initial position without any risk of the products to be treated colliding with elements of the lifting devices.

The transport path has a cross-section that is matched to the biggest products that are to be treated with the shrink tunnel, i.e. a cross-section whose height and width is greater than the height and width of the biggest products that are to be treated with the shrink tunnel.

The nozzle bodies, the guide plates, and the lifting devices, which are preferably configured as pulls or pull-like raising mechanisms, are located to the side of the transport path and outside the cross-section of said transport path. All drive elements are also arranged outside the cross-section of the transport path whatever the state of the guide plates.

Even when guide plates are in the lowest lifting position, products can be moved through the shrink tunnel 1 unimpeded, in particular without being impeded by the lifting devices and their drives.

In some embodiments, the guide plates can be moved not only parallel to their surface sides and perpendicular to their longitudinal extension but also perpendicular or essentially perpendicular to a transport plane of the transport path.

In other embodiments, at least one second guide plate is associated with each array of nozzle openings. The second guide plates are provided singly and separately at the arrays of the nozzle openings and that their position can be adjusted, preferably in height, by the lifting devices.

In yet other embodiments, whatever the position of the guide plates, the lifting devices and all elements of the drive of the lifting devices are arranged outside the cross-section which the transport path or the treatment chamber comprise in a plane lying square to the transport direction. This cross-section is matched to the dimensions of the biggest products to be processed with the shrink tunnel.

In still other embodiments, the first guide plate that is associated with the respective array of nozzle openings is engaged by at least two lifting devices, preferably at the ends of this guide plate.

In still more embodiments, the arrays of nozzle openings are each formed by at least one nozzle body comprising the nozzle openings or are each formed by at least two nozzle bodies that succeed one another in the transport direction and/or that are adjacent to one another.

Further embodiments include those in which at least one guide plate that is associated with the array of nozzle openings, preferably the at least one first guide plate, extends over the full length covered by the array of nozzle openings in the transport direction.

Yet other embodiments include those in which at least one second guide plate only extends over part of the length covered by the array of nozzle openings in the transport direction, and preferably over a part-length of the array of nozzle openings adjacent to the shrink tunnel inlet.

Also among the embodiments are those in which the second guide plate moves together with the first guide plate or with the lifting device of the guide plate for the controlled covering and releasing of nozzle openings, those in which the lifting devices are configured as pull-like raising mechanisms, for example as cable or chain pulls, and those in which each lifting element has its own discrete, preferably autonomously controllable drive.

In some embodiments, the two lifting devices lying opposite one another on the transport path are connected, for driving purposes, both to one another and to a drive, such as an electromotive drive, by way of a shaft that is arranged outside the overall cross-section of the transport path or of the treatment chamber.

In other embodiments, the first and second guide plates are configured and can be moved between an initial position and a final position in such a way that, when in the initial position, the guide plates are adjacent to one another and/or cover all nozzle openings that face the guide plates and that, when in the raised final position, they uncover all nozzle openings.

In yet other embodiments, the first guide plate and the second guide plate associated with it are arranged on different levels in such a way that when raised from its initial position, the first guide plate initially moves past the second guide plate and then entrains the second guide plate.

Embodiments also include those that have more than one of the foregoing features.

As used herein, "products" are generally at least partly wrapped in a shrink film.

As used herein, "containers" or "packaging media" are in particular cans, bottles, tubes, pouches, made from metal, glass and/or plastic, and other packaging media, in articular including such as are suitable for filling products that are in powder form, granulate-like, liquid or viscous.

As used herein, expressions such as "essentially," "in essence" or "around" mean variations from the respective exact value by ±10%, preferably by ±5% and/or variations in the form of changes insignificant for the function.

Further embodiments, advantages and possible applications of the invention arise out of the following description of embodiments and out of the figures. All of the described and/or pictorially represented attributes whether alone or in any desired combination are fundamentally the subject matter of the invention independently of their synopsis in the claims or a retroactive application thereof. The content of the claims is also made an integral part of the description.

BRIEF DESCRIPTION OF THE DRAWINGS

The invention is explained further below in conjunction with the figures and by reference to an embodiment. In the figures.

DETAILED DESCRIPTION

Figure 1:
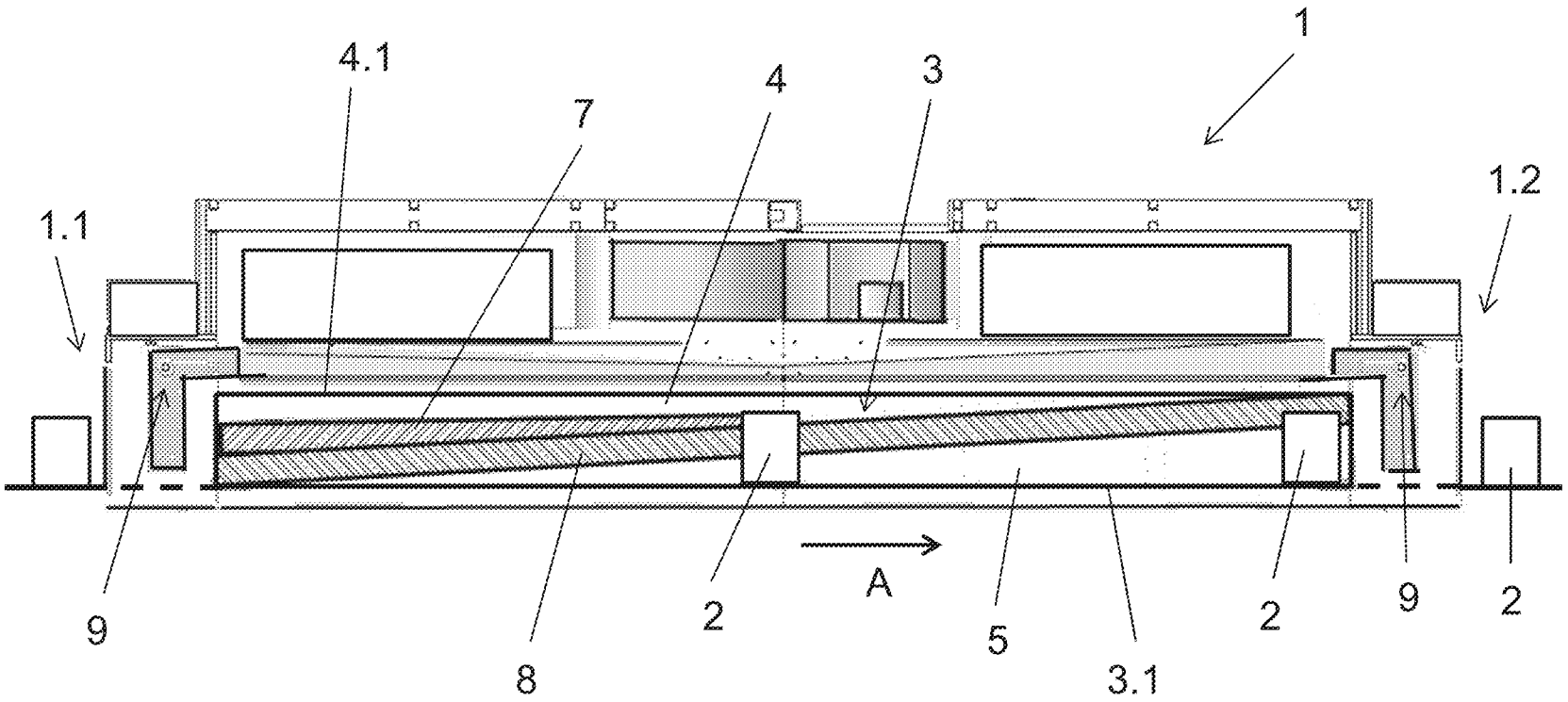
FIG. 1 shows a simplified representation of a longitudinal section through a shrink tunnel.
Figure 2:
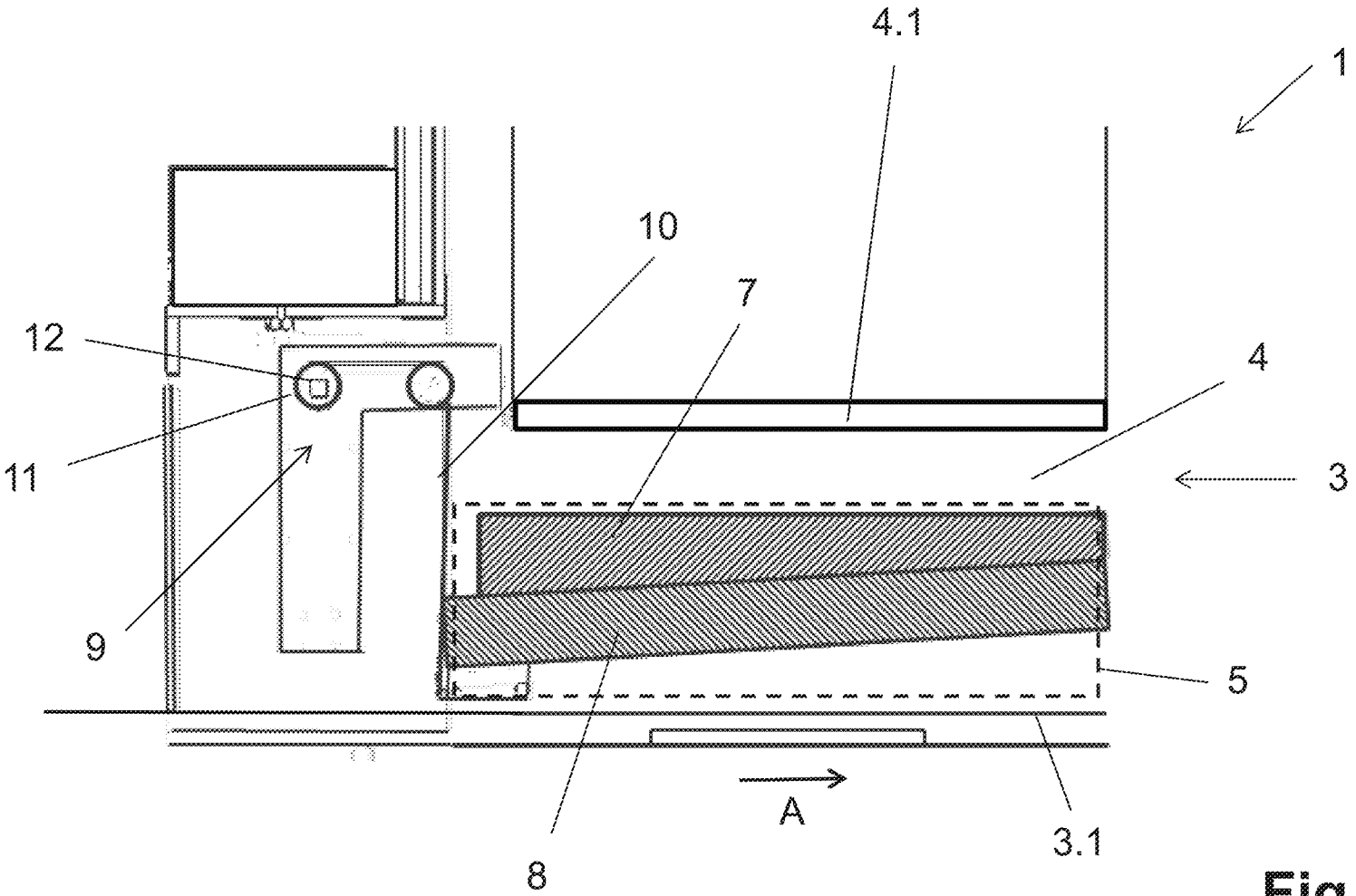
FIG. 2 shows a magnified part-representation of FIG. 1.

FIG. 1 shows a shrink tunnel 1 for shrinking a shrink film on products 2. A transport path 3 having a conveyor 3.1 conveys products 2 along a transport direction A from an inlet 1.1, through a treatment chamber 4, and on to an outlet 1.2 of the shrink tunnel 1. The conveyor 3.1 forms a horizontal or essentially horizontal transport plane TE on which the products 2 lie. The overall cross-section of the transport path 3 is selected to be large enough to allow even the tallest products to be treated to negotiate the transport path 3 without difficulty.

Figure 3:
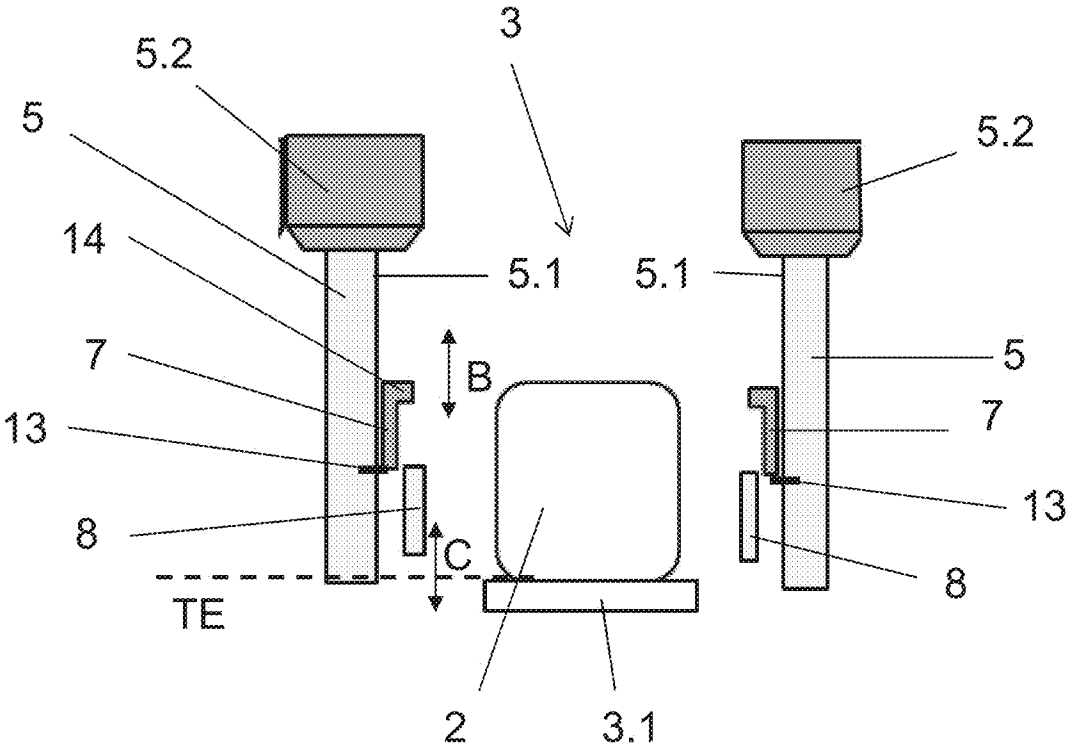
FIG. 3 shows a schematic representation of two nozzle bodies of the shrink tunnel of FIG. 1 provided on either side of a transport path.

Referring to FIG. 3, each side of the transport path 3 has a nozzle body 5 that extends along it in the transport direction A. Each nozzle body 5 directs hot air across the transport path 3 so that it impinges on products 2 that are on the transport path 3.

Each nozzle body 5 is a hollow body that has an inner wall 5.1 facing the transport path 3. The inner walls 5.1 of the two nozzle bodies 5 thus face each other across the transport path 3.

Each inner wall 5.1 defines a plane that extends vertically upward and horizontally along the transport direction A. Nozzle openings 6 perforate the inner wall 5.1. An upper distribution-channel 5.2 extends along the inner wall 5.1 in the transport direction A. The upper distribution-channel 5.2 distributes air from a heater into the interior of the nozzle body 5 so that it comes out the nozzle openings 6.

For the shrink tunnel 1 to process products 2 of varying size, and in particular products 2 of different heights, and/or to guarantee that only certain desired regions are acted upon by the hot air leaving the nozzle openings 6, each nozzle body 5 has associated first and second guide plates 7, 8 that act as shutters.

The first guide plate 7 is adjustable to move along a first direction B. The second guide plate 8 is adjustable to move along a second direction C. The first and second directions B, C are both vertical. This allows the first and second guide plates 7, 8 to be placed in front of selected nozzle openings 6 to cover them. Guides located at the nozzle bodies 5 but outside the cross-section of the transport path guide the first and second guide plates 7, 8.

In the illustrated embodiment, the first and second guide plates 7, 8 are both rectangular plates having their major axes oriented along the transport direction A. The first guide plate 7 is a short guide plate that extends over the nozzle body 5 only in the region of the inlet 1.1. The second guide plate 8 extends the full length of the nozzle body 5.

It should be noted that the structure is symmetric so that each nozzle body 5 has associated first and second guide plates 7, 8 as described above.

The first and second guide plates 7, 8 are individually guided. Separate lifting devices 9 are provided for movement of each second guide plate 8. In the illustrated embodiment, each second guide plate 8 has two lifting devices 9 that act on the ends thereof. The lifting devices 9 and all functional elements thereof are arranged wholly outside the overall cross-section of the transport path 3.

In the illustrated embodiment, the lifting device 9 is a pull-like raising mechanism, such as a cable pull. Such a lifting device includes a cable drum 11 that coils a cable 10 when raising the guide plate 8 and that uncoils the cable 10 when lowering the guide plate 8. In some embodiments, one drive powers several lifting devices 9. However, it is also possible for each lifting device 9 to have its own independent drive.

In the region of the inlet 1.1 and also in the region of the outlet 1.2 there are therefore two lifting devices 9, with the two lifting devices 9 in the region of the inlet 1.1 and the two lifting devices 9 in the region of the outlet 1.2 each having a common drive, such as an electromotive drive, for driving the cable drums 11.

To implement this embodiment, the two cable drums 11 at the inlet 1.1 and the two cable drums 11 at the outlet 1.2 are on a common shaft 12 that is driven by the drive and that extends horizontally perpendicular to transport direction A far above the transport path 3 or an upper limit 4.1 of the treatment chamber 4. The second guide plates 8 return to their lower initial position by gravity.

The first guide plates 7 are mounted so as to move freely in the vertical direction. Stops 13, best seen in FIG. 3, define the lower initial position of the first guide plates 7. The stops 13 are disposed such that, when in the first guide plate 7 is in its lower initial position, it is immediately adjacent to the second guide plate 8 lying below it, which is also in its lower initial position, as shown in FIGS. 3-5.

In the illustrated embodiment, the first guide plate 7 is nearer to the inner wall 5.1 of the nozzle body 5 than the second guide plate 8 that is provided on the same side of the transport path 3. When the second guide plate 8 is raised, it initially moves past the first guide plate 7. As the second guide plate 8 continues upward, its upper edge approaches and eventually contacts a projection 14 in the first guide plate 7. At this point, the first guide plate 7 becomes entrained with the second guide plate 8.

As shown in FIGS. 3-9, appropriately activating the lifting devices 9 leads to widely differing positions and/or orientations for the first and second guide plates 7, 8. This makes it possible to control which nozzle openings 6 along the transport path are uncovered, and therefore able to release air, and which ones are covered.

Figure 5:
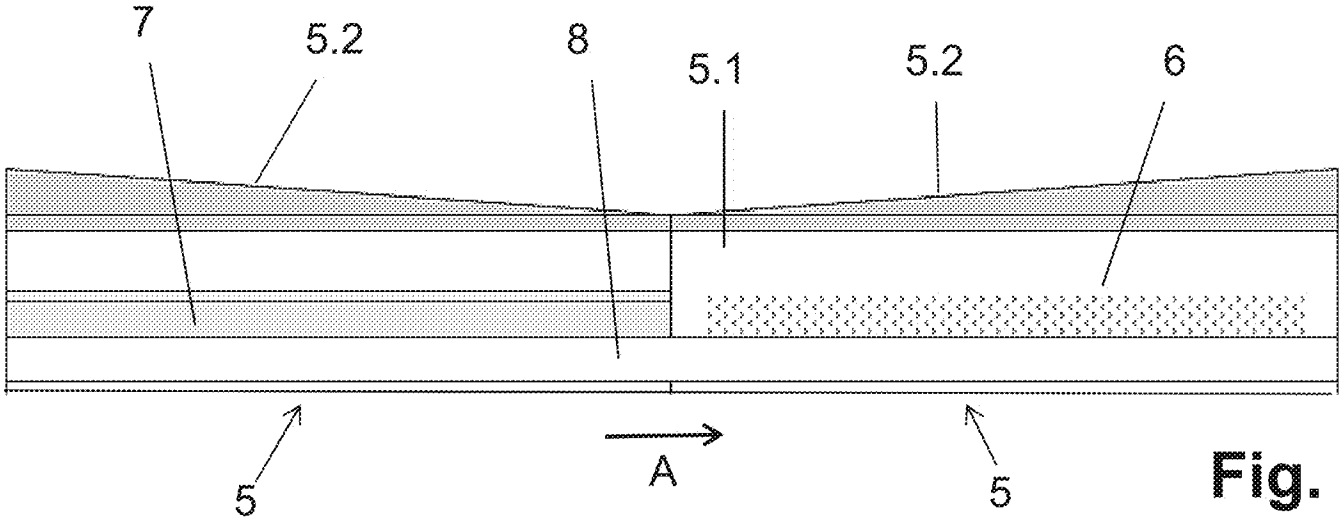
FIGS. 4 and 5 show an end-on view and a side view of two nozzle bodies adjacent to one another, together with two guide plates in their lowest initial position.
Figure 7:
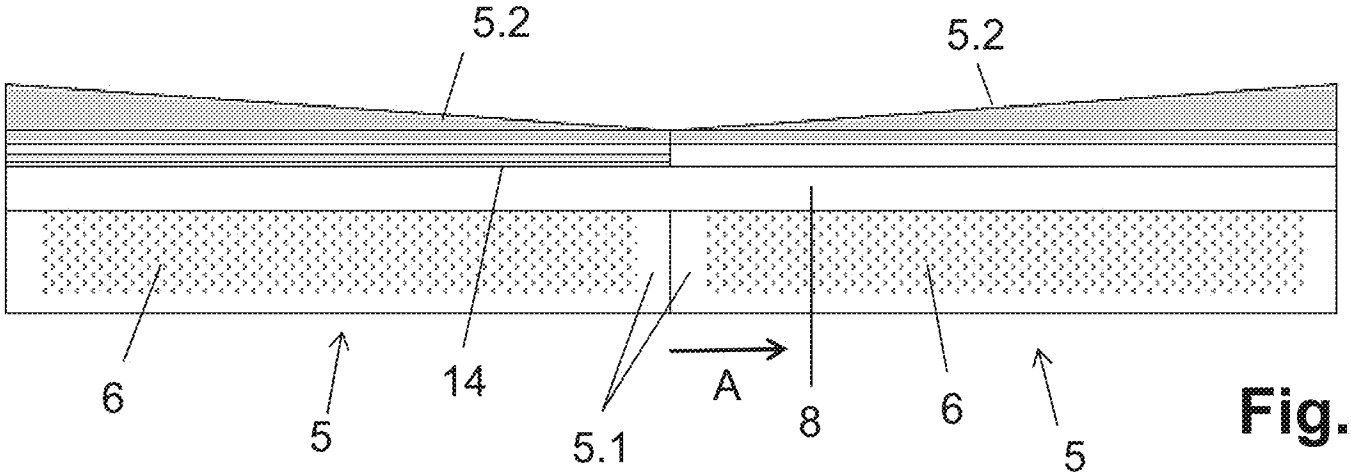
FIGS. 6 and 7 show an end-on view and a side view of the two nozzle bodies adjacent to one another, together with the guide plates in their uppermost final position.
Figure 4:
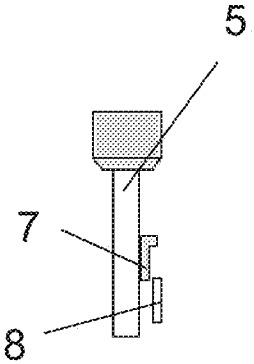
Figure 6:
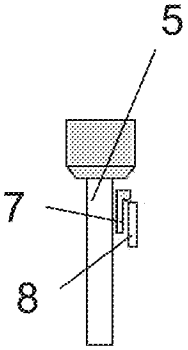

FIGS. 3-5 show a state in which the first and second guide plates 7, 8 are in their lowest positions, which correspond to their initial positions. In FIGS. 6 and 7, the first and second guide plates 7, 8 are in their highest positions on either side of the transport path 3.

Figure 9:
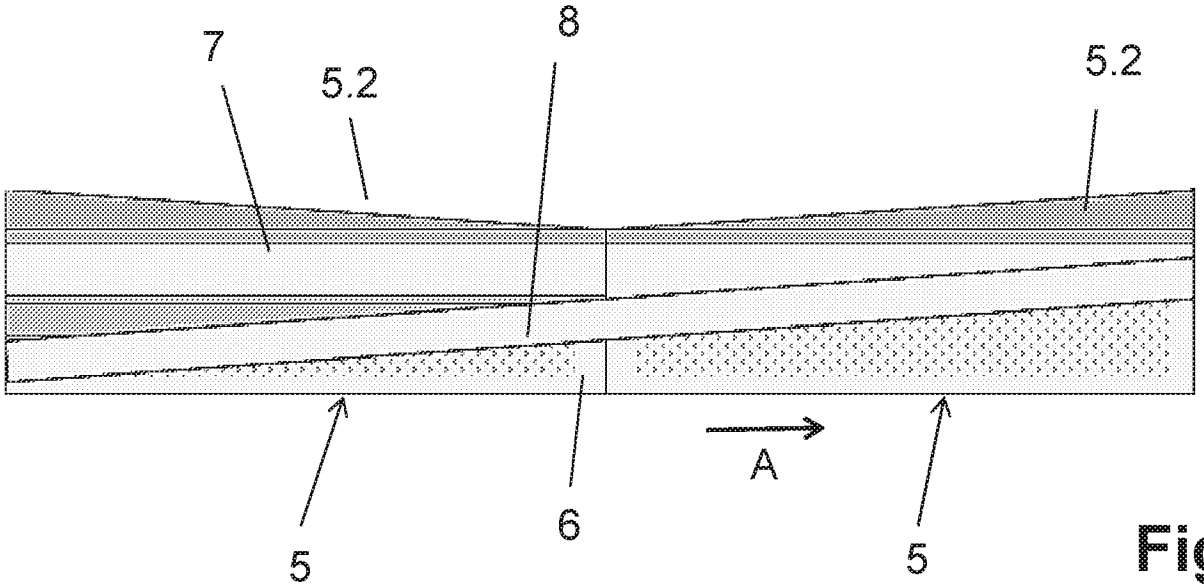
FIGS. 8 and 9 show an end-on view and a side view of the two nozzle bodies adjacent to one another, together with the guide plates, one of which being in its lowest initial position and the other being set at an angle.
Figure 8:
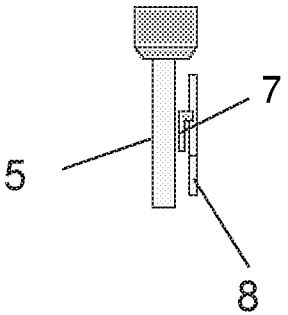

In FIGS. 8 and 9, on either side of the transport path 3, a stop 13 defines the lowest position of the first guide plate 7. The second guide plate 8 is set at an angle so that the number of uncovered nozzle openings 6 increases on either side of the transport path 3. This can be achieved by lifting only at one end. Only the nozzle openings 6 that are beneath the second guide plate 8 are uncovered for the delivery of the hot gaseous medium.

Other orientations of the guide plates 7, 8 are also possible through appropriate activation of the lifting devices 9.

Figure 10:
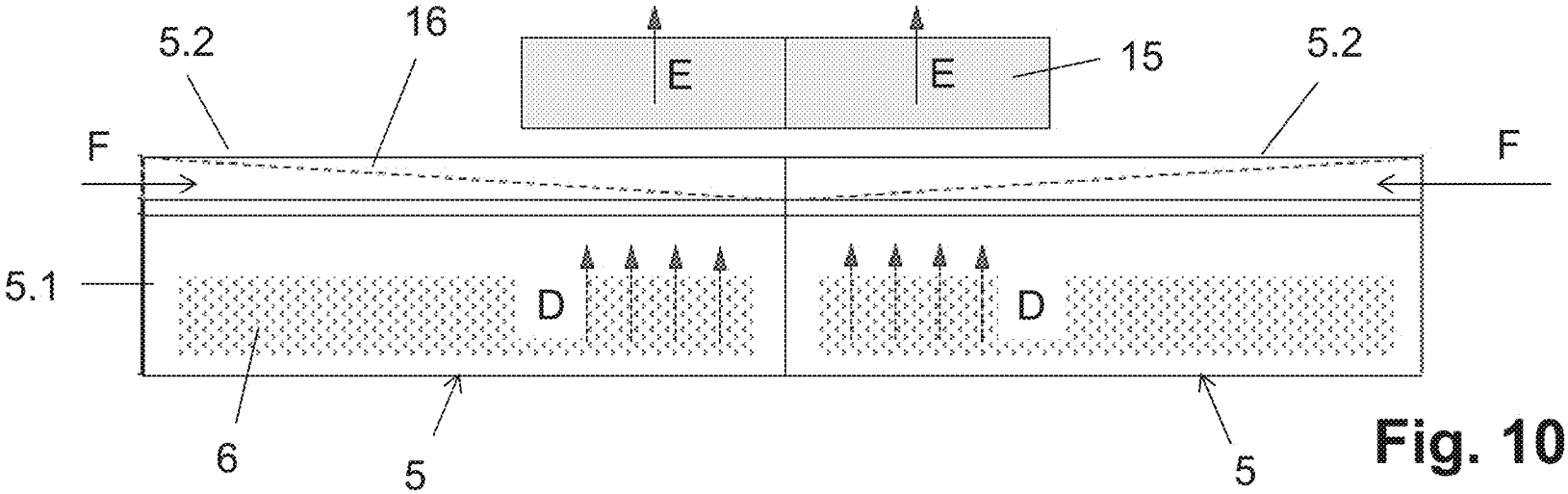
FIGS. 10 and 11 show side views of the two nozzle bodies adjacent to one another, with guide plates removed.
Figure 11:
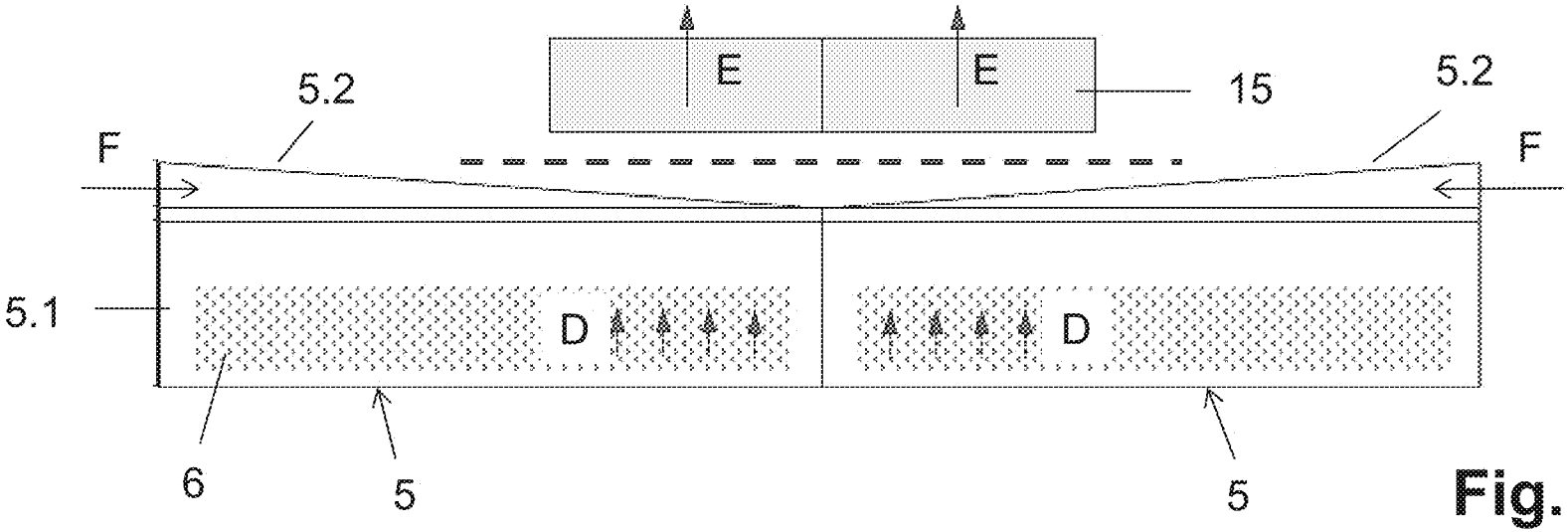

FIGS. 10 and 11 again show representations similar to FIGS. 5, 7 and 9, with the two nozzle bodies 5 succeeding one another in the transport direction A without the first and second guide plates 7, 8 on one side of the transport path 3. Arrows D indicate the delivery of the hot air from nozzle openings 6. Fans 15 extract hot air from the interior of the shrink tunnel 1. A flow plate 16 inside the upper distribution-channel 5.2 promotes more even distribution of hot air over the full length of the nozzle body 5. The flow plate 16 increasingly reduces the height or the upper distribution-channel 5.2 and hence the cross-section of that channel in the direction of flow of the incoming hot air. In the embodiments shown in FIGS. 5, 7, 9, and 11, an inclined flow plate 16 defines the top of the upper distribution-channel 5.2.

The invention has been so far explained by reference to one embodiment. However, modifications are possible, some of which are enumerated below.

It is, for example, possible to provide only one nozzle body 5 or on the other hand more than two nozzle bodies 5 in sequence on each side of the transport path 3.

It is not absolutely necessary to have just first and second guide plates 7, 8 on either side of the transport path 3. The number of guide plates may differ from this.

It is also not necessary for a guide plate on either side of the transport path 3 to extend over all the nozzle bodies 5 provided on this transport path side and/or over the entire length of the treatment chamber 4.

It is also not for the lifting devices 9 to be formed by cable pulls. Other drives for raising and lowering the second guide plates 8 can be used.

It has so far been assumed that the products are conveyed through the shrink tunnel 1 in single file. However, it is possible to convey products 2 are conveyed through the shrink tunnel 1 in multiple tracks. In such cases, the shrink tunnel comprises at least two parallel transport paths 3 on which arrays of nozzle openings 6 or nozzle bodies 5 having the nozzle openings 6 and having guide plates, e.g. guide plates 7, 8, on either side.

The invention claimed is:

1. An apparatus comprising a shrink tunnel for shrinking shrink films on packages, said shrink tunnel comprising a transport path, a treatment chamber, arrays of nozzle openings, a plurality of guide plates, and a plurality of lifting devices, wherein said transport path, which passes through said treatment chamber, extends between an inlet and an outlet of said shrink tunnel, wherein said arrays are on opposite sides of said transport path, wherein hot gas exiting said nozzles shrinks said shrink film, wherein each array has an associated guide plate from said plurality of guide plates, wherein each of said guide plates has at least one associated lifting device from said plurality of lifting devices for adjustment thereof, wherein said guide plates cover selected nozzle openings, wherein said lifting devices adjust positions of said guide plates, wherein said guide plates comprise a first and second guide plate, and wherein said second guide plate is entrained with said first guide plate for controlled covering and releasing of nozzle openings.

2. The apparatus of claim 1, wherein each array of nozzle openings has associated first and second guide plates, wherein said first guide plate has a first height above said transport path, wherein said second guide plate has a second height above said transport path, and wherein said lifting devices are configured to adjust said first and second heights independently of each other.

3. The apparatus of 1, wherein said shrink tunnel is configured to accommodate a range of package sizes, wherein, among said package sizes there exists a largest size, wherein, regardless of said heights, said lifting devices and drive elements of said lifting devices remain outside a cross section of said treatment chamber, and wherein said cross-section is adequate to permit passage of a package having said largest size.

4. The apparatus of claim 1, wherein said associated guide plate has at least two lifting devices associated therewith and wherein said at least two lifting devices engage said associated guide plate at ends thereof.

5. The apparatus of claim 1, further comprising nozzle bodies, each of which has nozzle openings therethrough, wherein said nozzle bodies comprise said arrays.

6. The apparatus of claim 1, wherein at least one of said guide plates extends all the way through said treatment chamber so that said guide plate extends over an entire length of an array of nozzle openings.

7. The apparatus of claim 1, wherein at least one of said guide plates extends part way through said treatment chamber, thereby extending over only a partial length of an array of nozzle openings.

8. The apparatus of claim 1, wherein said lifting devices are configured as a pulled raising mechanism.

9. The apparatus of claim 1, further comprising a controllable drive for each lifting device, said controllable drive being a discrete and autonomous drive.

10. The apparatus of claim 1, wherein said guide plates comprise first and second guide plates that can be moved between initial and final positions, wherein, in said initial position, said first and second guide plates cover all nozzle openings, and wherein, in said final position, said first and second guide plates uncover all nozzle openings.

11. The apparatus of claim 1, wherein said guide plates comprise first and second guide plates, wherein said first and second guide plates are arranged on different levels, and wherein, as said first guide plate is raised from an initial position thereof, said first guide plate initially moves past said second guide plate and then entrains said second guide plate.

12. The apparatus of claim 1, wherein said lifting devices are configured as cable pull devices.

13. The apparatus of claim 1, further comprising a shaft connecting first and second lifting devices from said plurality of lifting devices, said first and second lifting devices facing each other across said transport path, and an electromotive drive for driving said first and second lifting elements in common via said shaft, wherein said electromotive drive and said shaft are outside said transport path.

* * * * *